US005257783A

United States Patent [19]

Callaghan

[11] Patent Number: 5,257,783

[45] Date of Patent: Nov. 2, 1993

[54] TRIANGULAR FOOTBALL

[75] Inventor: Michael L. Callaghan, Yuma, Ariz.

[73] Assignee: Klutz, Inc., Palo Alto, Calif.

[21] Appl. No.: 33,499

[22] Filed: Mar. 18, 1993

[51] Int. Cl.[5] ..... A63F 7/40

[52] U.S. Cl. ..... 273/128 R; 273/65 R; 273/94

[58] Field of Search ..... 273/424, 128 R, 94, 273/65 R, 65 E, 58 R, 58 A; 5/636

[56] References Cited

U.S. PATENT DOCUMENTS

| | | | |
|---|---|---|---|
| 1,068,355 | 7/1913 | McComb | 5/636 X |
| 1,754,937 | 4/1930 | Comstock | 5/636 |
| 3,426,372 | 2/1969 | Enelow | 5/636 |
| 4,060,863 | 12/1977 | Craig | 5/636 |
| 4,460,179 | 7/1984 | Hafer | 273/428 X |
| 4,555,114 | 11/1985 | Dozier | 273/128 R |
| 4,878,668 | 11/1989 | Nevoral | 273/128 R |
| 5,067,730 | 11/1991 | Wanalista | 273/428 X |
| 5,110,127 | 5/1992 | Potter | 273/94 X |
| 5,180,171 | 1/1993 | Panzica et al. | 273/428 |

FOREIGN PATENT DOCUMENTS

| | | | |
|---|---|---|---|
| 278524 | 9/1914 | Fed. Rep. of Germany | 5/636 |
| 1344036 | 1/1974 | United Kingdom | 5/636 |

*Primary Examiner*—Paul E. Shapiro
*Attorney, Agent, or Firm*—Limbach & Limbach

[57] ABSTRACT

A triangular football is disclosed which consists of two pieces of leather sewn together about their periphery. The interior of the football is filled with an acrylic fiber, causing the central region to bulge outwardly. The football is suitable for use with various tabletop football games.

13 Claims, 1 Drawing Sheet

TRIANGULAR FOOTBALL

TECHNICAL FIELD

The subject invention relates to a toy apparatus and particularly a triangular football suitable for tabletop games.

BACKGROUND OF THE INVENTION

For many years, school children have been playing various tabletop games during lunchtime. One of the more popular games is tabletop football. The game is played with a triangularly shaped, planar football typically made from a folded piece of notepaper.

While there are many variations, in the basic game, two players sit opposite each other across the table. With the football lying on its side, the first player flicks a finger in a manner to propel the football across the table. As the football travels, it typically rotates about it axis. If the football fails to reach the other side of the table or goes past the edge and falls off, no points are scored. However, if the player is successful in causing the football to stop in a manner such that only a portion thereof extends beyond the edge of the table, a touchdown is scored.

If a touchdown is made, the shooting player may attempt an extra point. In this situation, the other player will form a "goal post" with his fingers. The shooter will stand the football in an upright position, with one corner resting on the table and another corner held by a finger. The shooter will then flick a finger in a manner to project the football into the air. If the football passes over and between the make-shift goal posts, and extra point is awarded. A similar procedure is performed with field goals.

One of the drawbacks with this form of play is that footballs formed out of notepaper were not very durable. As the football was used, its shape and rigidity would change so that play would not be consistent. In addition, the presence of various liquid refreshments in the lunchroom posed risks for the life of a paper football. Further, a paper football tends to be flat. When flicked across the table, significant friction arises between the football and the table, inhibiting the spinning motion. Another problem with footballs made from notepaper is that the corners of the triangle come to a sharp point, making it difficult to balance the football in a stable manner during a field goal attempt.

Accordingly, it would be desirable to develop a triangular football suitable for tabletop games which did not suffer from these drawbacks.

SUMMARY OF THE INVENTION

The football of the subject invention is formed from two, substantially identical pieces of leather cut into the desired triangular shape. The two pieces are stitched together around the periphery thereof. In addition, a filler material is placed between the two pieces in a manner to make the central region bulge outwardly. Preferably, the width in the central region is at least twice the width of the football at its edges.

The subject football addresses the problems of the prior art. Since it is formed from leather, the football is durable and can be used repeatedly. In addition, the bulge in the central region reduces the area of contact with the tabletop, thereby reducing friction and allowing the football to spin more evenly, providing a more consistent game. The filling also adds mass which allows the football to travel through the air with less variation.

In the preferred embodiment, the corners of the football are rounded, providing stability while balancing the football during a field goal attempt.

Further objects and advantages will become apparent from the following detailed description, taken in conjunction with the drawings in which:

DETAILED DESCRIPTION OF THE PREFERRED EMBODIMENT

Referring to FIGS. 1 to 4, the triangular football 10 of the subject invention is illustrated. Football 10 includes a pair of opposed triangular members 20. Each triangular member 20 is formed from leather which, in the preferred embodiment, is cowhide with a natural finish which. Each member 20 is substantially planar having a thickness ranging between 1.5 mm to 2.0 mm.

Figure 1:
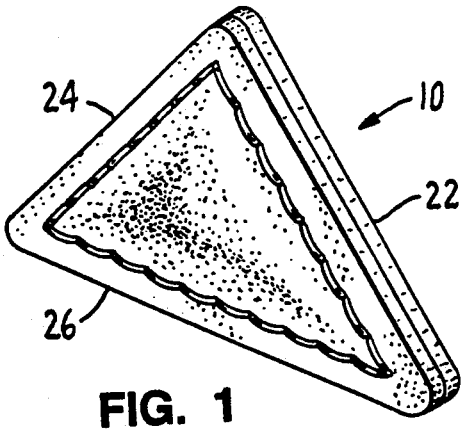
FIG. 1 is a perspective view of the triangular football of the subject invention.
Figure 2:
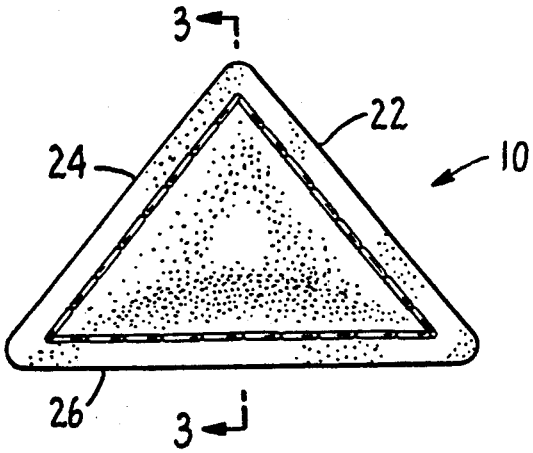
FIG. 2 is a side view of the triangular football of the subject invention.

The length of two of the side edges (22, 24) of the triangular configuration are equal to define an isosceles triangle. In the preferred embodiment, the length of sides 22 and 24 is 56 mm while the length of the remaining side 26 is 72 mm. The angle between edges 22 and 24 is 80 degrees and the remaining two angles are 55 degrees. As best seen in FIG. 2, the corners of the football are preferably rounded.

The triangular members are attached to each other with a cotton thread 30 sewn around the periphery thereof. The thread is spaced from the outer edges of the football by 4 mm. There are about 1.6 stitches/cm.

In accordance with the subject invention, the interior of the football is stuffed with a filler material 40. In the preferred embodiment, the filler material is formed from an acrylic fiber having a weight between 0.8 and 1.0 grams. The total weight of the football is about 8.5 grams.

Figure 3:
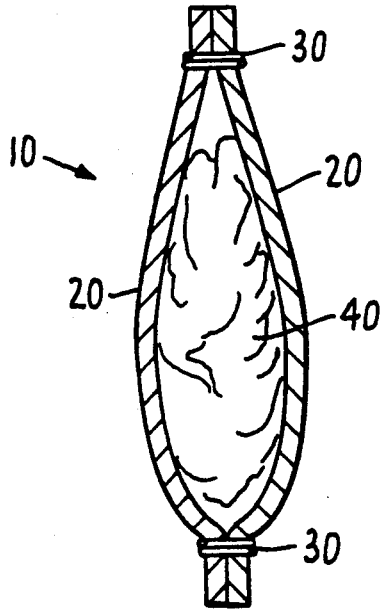
FIG. 3 is a cross-sectional view taken along the lines 3—3 in FIG. 2 of the triangular football of the subject invention.
Figure 4:
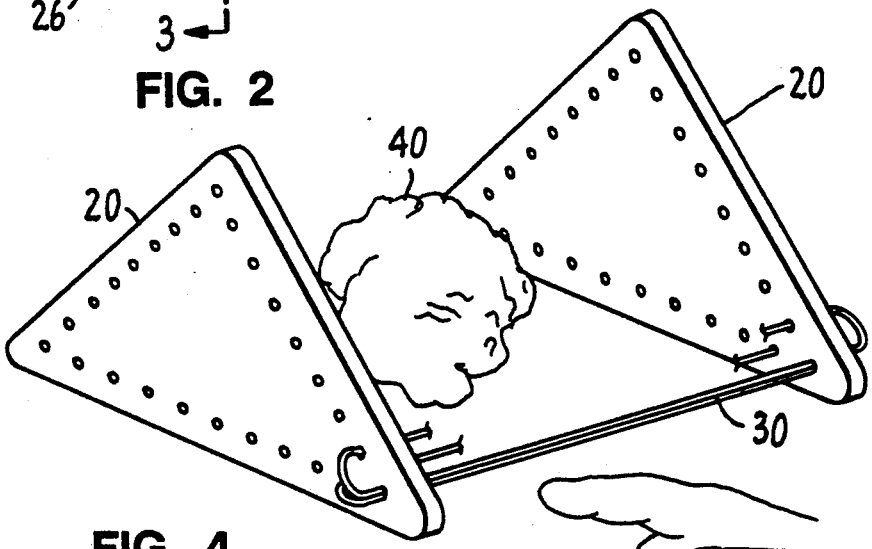
FIG. 4 is an exploded perspective view of the triangular football of the subject invention.

Since the members 22, 24 are formed from a flexible material, the addition of the filler 40 causes the central region of the football to bulge outwardly (see FIG. 3). The thickness of the football at the center is between two and four times thicker than the thickness of the football at its outer edge. In the preferred embodiment, the thickness of the central region is 11 mm, which is about three times thicker than the thickness of the football at its outer edge.

Figure 5:
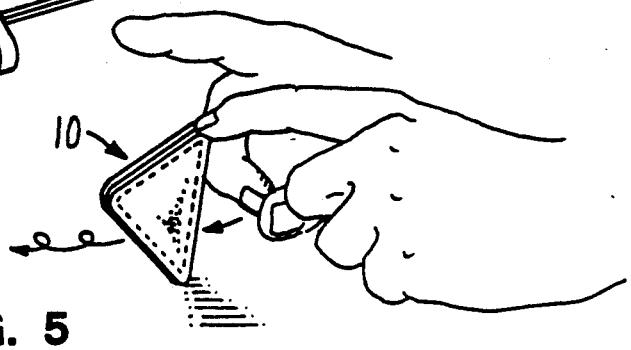
FIG. 5 is a drawing of a player flicking a finger in a manner to project the football in an upwards and outward direction.

As noted above, the subject football provides significant advantages over the paper footballs used to date. In addition to being more durable, the unique shape and weight improves play. The central bulge reduces friction allowing the football to spin faster and perform more uniformly. The rounded corners aid the shooter in balancing the football in a stable manner during a field goal attempt as illustrated in FIG. 5. The shape and weight of the device also provides for good aerodynamic stability when the football is struck into the air.

While the subject invention has been described with reference to a preferred embodiment, various changes and modifications could be made therein, by one skilled in the art, without varying from the scope and spirit of the subject invention as defined by the appended claims.

I claim:

1. A sporting apparatus comprising:

a first planar member;

a second planar member, with both of said members having a triangular configuration of the same dimensions, said members being disposed in aligned and abutting relationship, said members being formed from a durable, flexible material;

means for attaching the first member to the second member around the peripheries thereof; and a filler material captured between the members and causing the members to bulge outwardly in the central region of the apparatus.

2. An apparatus as recited in claim 1 wherein the width of the apparatus in the central region is at least twice as large as the width of the apparatus at the periphery thereof.

3. An apparatus as recited in claim 2 wherein the angles defined at two of the corners of the triangular members are each 55 degrees and the angle of the remaining corner is 80 degrees.

4. An apparatus as recited in claim 1 wherein the configuration of the members is an isosceles triangle.

5. An apparatus as recited in claim 4 wherein two of the side edges of said members are 56 mm inches in length and the remaining side is 72 mm in length.

6. An apparatus as recited in claim 5 wherein said filler material is formed from an acrylic fiber having a weight between 0.8 and 1.0 grams.

7. An apparatus as recited in claim 1 wherein said filler material is formed from acrylic fiber.

8. An apparatus as recited in claim 1 wherein said members are formed from leather.

9. An apparatus as recited in claim 1 wherein said means for attaching the members together is defined by a stitched thread.

10. An apparatus as recited in claim 9 wherein there are about 1.6 stitches/cm.

11. An apparatus as recited in claim 1 wherein the corners of the triangular members are rounded.

12. An apparatus as recited in claim 1 wherein the width of the apparatus in the central region is between two and four times the width of the apparatus at the periphery thereof.

13. An apparatus as recited in claim 1 wherein the width of the apparatus in the central region is about three times the width of the apparatus at the periphery thereof.

* * * * *